US005265571A

United States Patent [19]

Sodeno

[11] Patent Number: 5,265,571

[45] Date of Patent: Nov. 30, 1993

[54] IDLE SPEED CONTROL SYSTEM FOR INTERNAL COMBUSTION ENGINE

[75] Inventor: Tsuyoshi Sodeno, Yokohama, Japan

[73] Assignee: Nissan Motor Co., Ltd., Yokohama, Japan

[21] Appl. No.: 36,406

[22] Filed: Mar. 24, 1993

[30] Foreign Application Priority Data

Mar. 31, 1992 [JP] Japan ..... 4-077021

[51] Int. Cl.[5] ..... F02D 41/16

[52] U.S. Cl. ..... 123/339

[58] Field of Search ..... 123/339, 585

[56] References Cited

U.S. PATENT DOCUMENTS

| | | | |
|---|---|---|---|
| 4,562,808 | 1/1986 | Tominaga et al. | 123/339 |
| 4,748,951 | 6/1988 | Manaka et al. | 123/339 |
| 4,753,202 | 6/1988 | Hasebe et al. | 123/339 |
| 4,836,164 | 6/1989 | Morozumi et al. | 123/339 |
| 5,065,717 | 11/1991 | Hosokai et al. | 123/339 |
| 5,153,446 | 10/1992 | Shimomura | 123/339 |

FOREIGN PATENT DOCUMENTS 61-237860 10/1986 Japan .

*Primary Examiner*—Willis R. Wolfe

*Attorney, Agent, or Firm*—Foley & Lardner

[57] ABSTRACT

An engine idle speed control system is designed to perform a transient correction in order to prevent an idle engine speed of an internal combustion engine from being made unstable by a load of an auxiliary unit, such as an air conditioner of a vehicle. The idle speed control system comprises an idle control valve provided in a bypass passage bypassing a throttle valve disposed in an intake passage of the engine, and a controller for controlling the idle engine speed by manipulating the opening degree of the idle control valve. The controller increases the opening degree of the idle control valve transiently when the load of the auxiliary unit is applied, and then decreases the opening degree with passage of time.

5 Claims, 4 Drawing Sheets

IDLE SPEED CONTROL SYSTEM FOR INTERNAL COMBUSTION ENGINE

BACKGROUND OF THE INVENTION

The present invention relates to a system for controlling an idle speed of an internal combustion engine in accordance with a change in load due to an air conditioner or other auxiliary (accessory devices or units).

An auxiliary device such as power steering pump, air conditioner or alternator of a vehicle make the idling operation of an internal combustion engine of the vehicle unstable. In order to prevent the idle speed (or rpm) of the engine from being made unstable by the load of such auxiliary devices, there is proposed an idle control system which controls the idle air amount so as to ensure a prescribed idle speed in accordance with loads of the auxiliary devices by controlling an idle control valve for regulating the air flow bypassing the throttle valve.

When the air conditioner is switched on during idling, for example, this conventional idle speed control system performs such a feedback control as to reduce a deviation of a sensed actual idle speed from a desired idle speed which is predetermined as a target while the air conditioner is on. An idle speed control system of this type is shown in a Japanese Patent Provisional Publication No. 61-237860.

In the idle speed control system of such a conventional type, a correction quantity of an idle air amount (air flow rate) corresponding to a load increase due to the air conditioner or other auxiliary devices is preliminarily determined. When the load is imposed, the control system performs the feedback control by adding the predetermined correction quantity so as to maintain a stable idling performance in spite of the change of the load.

This conventional system, however, cannot avoid suffering a temporary decrease of the idle speed due to a delay between the detection of increase of the load, and a responsive action of the control system. Recovery from the temporary decrease takes a significant time, during which the engine tends to produce undesirable vibrations. If the correction quantity is set at a high level in order to prevent this temporary decrease of the idle speed, then this control system would suffer an excessive increase of the idle speed by overshoot, and an undesired fall of the idle speed caused by undershoot when the load is removed.

SUMMARY OF THE INVENTION

It is therefore an object of the present invention to provide an engine idle speed control system which can provide stable and adequate idling performance of an internal combustion engine even when a load of an auxiliary or accessory system is put in or cut off.

According to the present invention, an idle speed control system for an internal combustion engine comprises:

an idle control valve disposed in a bypass passage bypassing a throttle valve provided in an intake passage for the engine;

a sensing means for sensing an idling condition of the engine, an engine speed of the engine, and a load of at least one auxiliary device (or accessory unit);

a controlling means for determining a desired idle speed, controlling an opening degree of said idle control valve during idling so as to achieve said desired idle speed, and further controlling the opening degree of said idle control valve in response to the load of the auxiliary device in such a transient manner that the opening degree of said idle control valve is increased when the load is applied, and then decreased with passage of time.

When the engine load is increased by the auxiliary device (or accessory) such as an air conditioner or a compressor of the air conditioner, this idle speed control system controls the opening degree of the idle control valve so as to bring the actual idle engine speed closer to the desired idle speed despite the increase of the engine load. At the same time, the control system further increases the opening degree of the idle control valve temporarily at the beginning of the increase of the engine load. In this way, the idle control system can prevent the idle speed from being decreased temporarily immediately after the increase of the engine load. This increase of the opening degree of the idle control valve is temporary, and decreased gradually to zero with passage of time. Thereafter, the idle speed is controlled at a relatively low level while the engine load remains at the increased level.

DETAILED DESCRIPTION OF THE INVENTION

Figure 2:
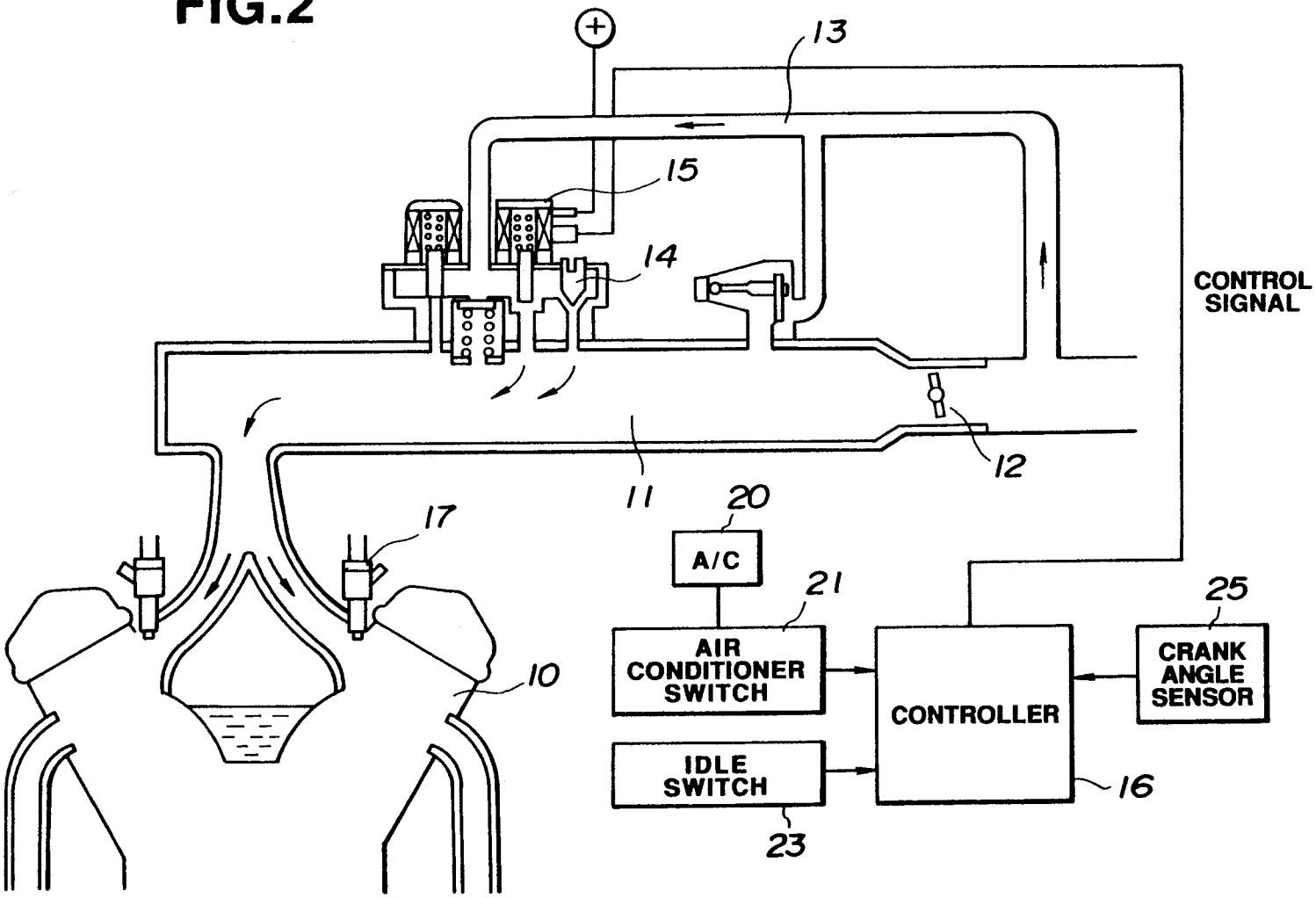
FIG. 2 is a schematic view showing an engine control system according to one embodiment of the present invention.

As shown in FIG. 2, an engine control system according to one embodiment of the present invention includes an internal combustion engine 10 of a vehicle, an intake passage 11 for introducing air into the engine 10, a throttle valve 12 disposed in the intake passage 11, a bypass passage 13 bypassing the throttle valve 12, an idle adjust screw 14 extending into the bypass passage 13, and an idle control valve 15 for varying an idle air amount (or an intake air flow during idling). The engine system of this example further includes one or more fuel injectors 17 for injecting fuel into the intake port of the engine in accordance with the intake air quantity.

This control system further includes a controller 16 serving as a control unit or control circuit for controlling the idle speed by manipulating the idle control valve 15 in accordance with one or more operating conditions of the engine system. This controller 16 serves as a feedback controller for manipulating the opening (degree) of the idle control valve 15 so as to bring the actual idle speed closer to a desired value, and adjusting the idle air amount in accordance with the engine load during idling.

The control system of the illustrated example further includes an air conditioner switch 21, an idle switch 23 and a crank angle sensor 25. These devices are main components of the sensing means according to the present invention. The air conditioner switch 21 serves as a load detecting means 4 (shown in FIG. 1) for sensing a load of at least one auxiliary device. In this example, the auxiliary device is a compressor of an air conditioning system 20, and the load detecting means is designed to sense the load required to drive the compressor. The idle switch 23 serves as an idle detecting means 2 shown in FIG. 1. The crank angle sensor 25 is used as an engine speed detecting means 3 shown in FIG. 1. These devices 21, 23 and 25 are all connected with the controller 16, and arranged to send signals to the controller 16. The air conditioner switch 21 is arranged to switch on and off the air conditioner 20.

In the controller 16, desired idle speeds are predetermined and stored for various idling situations. For example, there is at least one desired idle speed used when the air conditioner is operating, and at least one desired idle speed chosen in accordance with the cooling condition (such as a coolant temperature) of the engine. The controller 16 corrects the desired opening degree of the idle control valve 15 by a predetermined amount in accordance with each condition, and performs a feedback control so as to reduce the deviation of the actual engine speed from the desired speed.

The controller 16 of this example detects imposition of the load of the air conditioning compressor by checking the signal supplied from the air conditioner switch 21, and varies the opening degree of the idle control valve 15 in the following transient manner. The controller 16 increases the opening degree of the idle control valve 15 by a predetermined amount immediately when the load is applied, and then decreases the opening degree as time elapses. With this transient increase of the opening degree, this control system can prevent an undesired fall of the idle speed immediately after turn-on of the air conditioning system.

Figure 3:
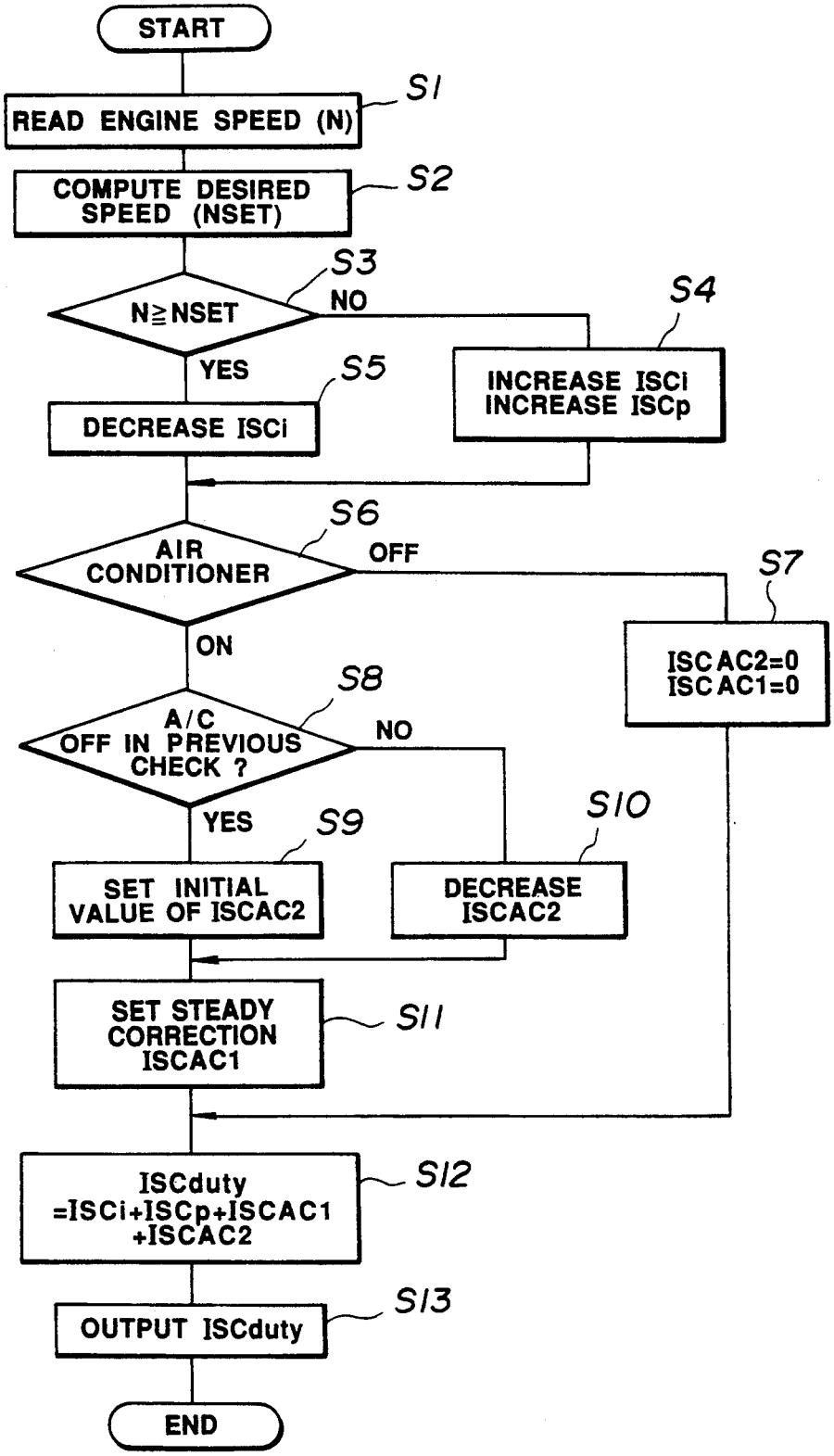
FIG. 3 is a flow chart showing a control procedure employed in the control system shown in FIG. 2.

FIG. 3 shows a control procedure which the controller 16 of this example performs.

At a step S1, the controller 16 (or a central processing unit of the controller 16) reads the engine speed (RPM) N. Then, the controller 16 computes a desired idle speed NSET in accordance with the current operating condition at a step S2. At a next step S3, the controller 16 compares the actual engine speed N with the desired engine speed NSET, and determines which to take between alternative courses of action in dependence on the result of the comparison. The controller 16 proceeds from the decision step S3, to a step S4 if N is lower than NSET, and to a step S5 if N is equal to or higher than NSET. When $N<NSET$, the controller 16 increases first and second control quantities ISCi and ISCp for the feedback control, respectively, by predetermined amounts of increase at the step S4. When $N \geqq NSET$, the controller 16 takes the step S5 and decreases the quantity ISCi for the feedback control by a predetermined amount of decrease, to decrease the idle speed.

Then, at a step S6, the controller 16 determines whether the air conditioning system 20 is on or off, by checking the signal of the air conditioner switch 21. When the air conditioner 20 is off, the controller 16 proceeds from the step S6 to a step S7, and sets each of a transient correction quantity ISCAC2 and a steady correction quantity ISCA1 equal to zero at the step S4. In this case, the controller 16 does not add the correction.

When the air conditioner 20 is in the on state, the controller 16 proceeds from the step S6 to a step S8, and determines, at the step S8, whether the air conditioner 20 was in the off state in the pervious examination or not. If the air conditioner 20 has been in the off state in the most recent execution of the step S6 but it is in the on state in the current execution, then the controller 16 proceeds from the step S8 to a step S9 to set an initial value of the transient correction quantity ISCAC2. In this example, the initial value of ISCAC2 set by the controller 16 at the step S9 is constant. However, it is optional to determine the initial value of ISCAC2 by a table look-up such that the initial value is increased as the temperature of the engine cooling water becomes low.

Figure 4:
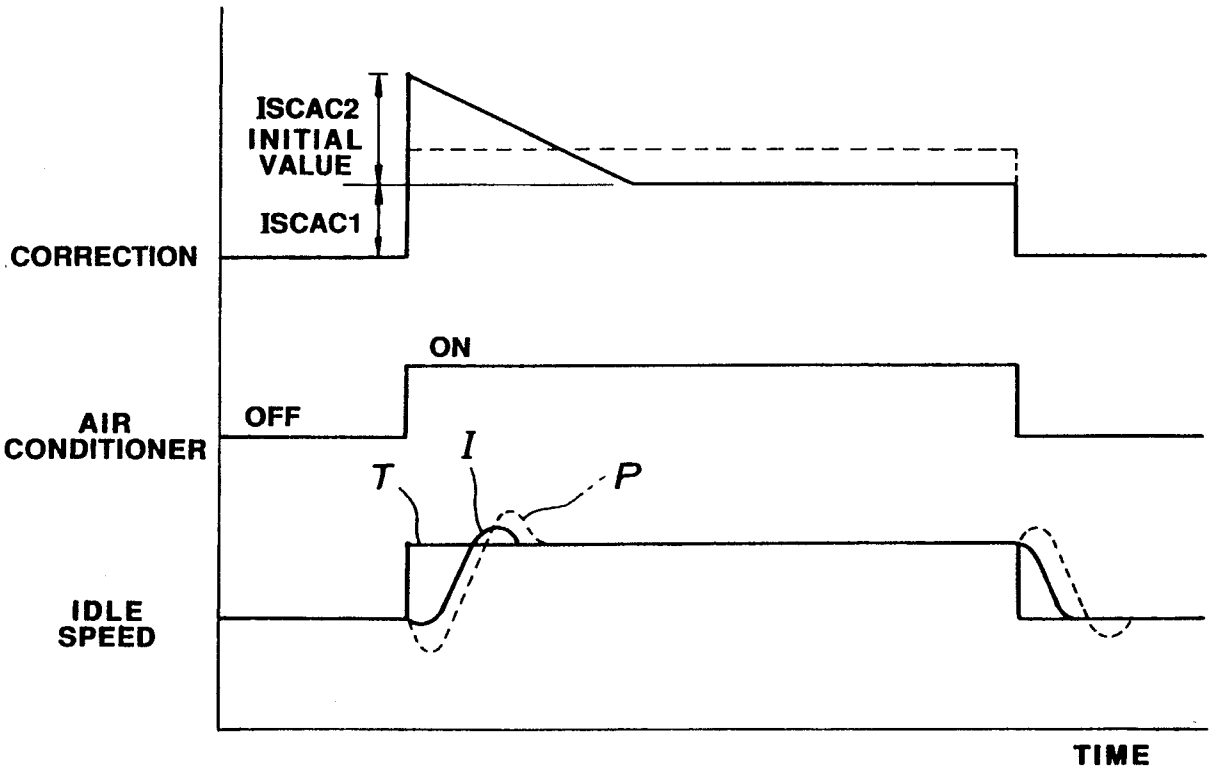
FIG. 4 is a timing chart showing control performance of the control system shown in FIG. 2.

If the air conditioner 20 was already in the on state in the previous check, then the controller 16 proceeds from the step S8 to a step S10, and decreases the transient correction quantity ISCAC2 by a predetermined amount at the step S10. Therefore, the controller 16 increases the transient correction quantity ISCAC2 from zero to the initial value immediately when the air conditioner 20 is switched on, and decreases the transient correction quantity ISCAC2 gradually from the initial value with time until ISCAC2 becomes equal to zero, as shown in FIG. 4. In the example shown in FIG. 4, the transient correction quantity ISCAC2 decreases linearly from the initial value to zero as the duration of the on period of the air conditioner increases.

At a step S11, the controller 16 reads the steady correction quantity ISCAC1 which is required to maintain the desired idle speed during the on period of the air conditioner.

At a step S12, the controller 16 determines the final control quantity ISCduty which is equal to a sum of ISCi, ISCp, ISCAC1 and ISCAC2. At a step S13, the controller 16 delivers the control signal representing $ISCduty=ISCi+ISCp+ISCAC1+ISCAC2$, to the idle control valve 15. In this way, the controller 16 controls the opening of the idle control valve 15 so as to make the actual idle speed approach the desired idle speed by repeating the program shown in FIG. 3.

When the air conditioner 20 is switched on and off, the idle speed control system according to this embodiment of the invention controls the idle speed as shown by a solid curved line I in FIG. 4. A broken curved line P shows a control performance of a conventional control system. A rectangular line T shows a desired value.

When the air conditioner switch 21 is turned on during the idling operation, the load of the compressor tends to decrease the engine speed. In order to prevent the engine speed from being decreased by the load of the compressor, the steady correction quantity ISCAC1 is added to increase the amount of the incoming air supplied to the engine by increasing the opening of the idle control valve 15. In accordance with this increase of the amount of the incoming air, the fuel injection quantity is increased. As a result, the engine output increases, and the engine speed becomes high.

Thus, the idle speed control system can normally protect the idle speed adequately from being affected by the load of the air conditioner. With this basic control alone, however, the control system cannot prevent a temporary decrease of the idle speed, as shown by the broken curved line P in FIG. 4, which occurs immediately after the application of the load of the air conditioner because of a response delay of the control system. This temporary decrease of the idle speed makes the idling operation unstable and incurs relatively strong, low-frequency vibrations.

The control system according to this embodiment of the invention can prevent this temporary idle speed decrease by using the transient correction quantity ISCAC2 as well as the steady correction quantity IS- CAC1. As shown by the solid curved line I in FIG. 4, therefore, the control system according to the invention can make this temporary decrease of the idle speed very small. When the air conditioner 20 is switched on, therefore, the idle speed varies smoothly from the initial low steady state value to the high steady-state value corresponding to the desired value for the air conditioner on period. In this way, the control system of the invention can ensure the smooth idling operation and prevent undesirable vibrations.

The transient correction quantity ISCAC2 decreases with passage of time until the transient correction quantity ISCAC2 becomes equal to zero at the end of a predetermined time interval starting from the turn-on of the air conditioner. Thereafter, the control system uses the steady correction quantity ISCAC1 only. Therefore, the idle speed is held at a level sufficient to fulfill the requirement, without being increased excessively high.

In the conventional control system which employs only the steady correction quantity ISCAC1, this steady correction quantity must be set at a high level, as shown by a horizontal straight broken line in FIG. 4, in order to prevent the temporary idle speed decrease due to the delay of the control action, and an engine stall caused by this temporary idle speed decrease. With the relatively high steady correction quantity, the conventional system may be able to prevent the temporary idle speed decrease. In this case, however, the conventional system must hold the idle speed vainly high all during the air conditioner on period, and suffer larger overshoot in the case of a turn-on of the air conditioner and undershoot in the case of a turn-off of the air conditioner.

By contrast, the control system according to the present invention can prevent the temporary decrease and the overshoot by using the transient correction quantity ISCAC2. Therefore, it is possible to minimize the steady correction quantity ISCAC1. The control system can cause the idle speed to vary smoothly also when the air conditioner is switched off. The idling operation is made stable when the load is removed, as well as when the load is applied.

The controller 16 may comprises an onboard microcomputer as a main component. The microcomputer can perform the control program of Gih. 3 periodically (every 10 ms, for example). In the illustrate example, the steady correction quantity ISCAC1 is set equal to a predetermined constant value at the step S11 of FIG. 3. It is optional to further employ a steady correction quantity and a transient correction quantity for each of the various auxiliary (accessory) units. When the load of one of the auxiliary units is applied on the engine, the controller increases the control quantity of the control signal by adding the corresponding steady correction quantity in a steady manner and further adding the corresponding transient correction quantity in a transient manner. When the loads of the power steering pump and the air conditioning compressor are applied simultaneously, for example, the controller adds all the steady and transient quantities for the power steering and the air conditioning initially, and decreases each transient correction quantity gradually with time. The controller 16 may be designed to further serve as a controller for the fuel injection control system and other engine control system.

The present invention is advantageous specifically when applied to an internal combustion engine of a vehicle as in the illustrated embodiment. In this case, the vehicle comprises an engine system comprising the internal combustion engine, the throttle valve in the intake passage for the engine, and the idle control valve in the bypass passage bypassing the throttle valve; the before-mentioned sensing means; the before-mentioned controlling means; and one or more auxiliary units.

The controlling means of the present invention may comprise a first processing means (or first processing section) for setting the desired idle speed, a second processing means (or section) for controlling the opening degree of the idle control valve and a third processing means (or section) for initially increasing the opening degree of the idle control valve when the load of the auxiliary device (or unit) is applied, and decreasing the opening degree of the idle control valve gradually with passage of time.

Figure 1:
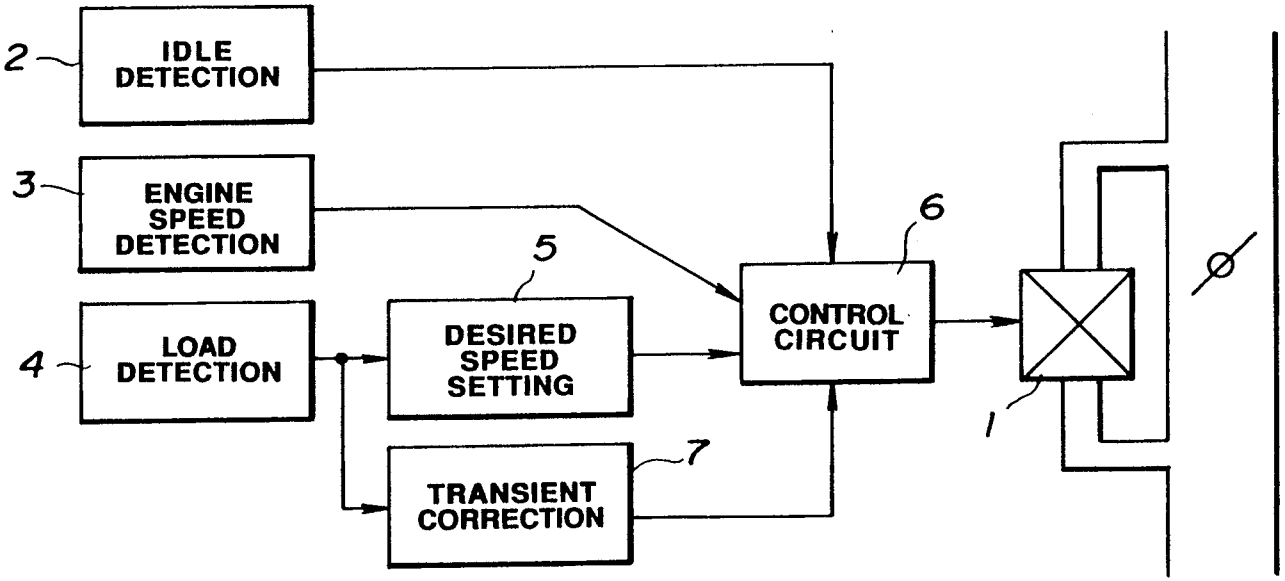
FIG. 1 is a schematic view showing various means used in the present invention.

The first processing means, such as a section 5 shown in FIG. 1, may comprise a desired idle speed setting means for setting the desired idle speed, a comparing means for comparing the actual idle engine speed with the desired idle speed to determine a deviation therebetween, and a feedback controlling means for determining a feedback control quantity, such as ISCi and ISCp, so as to reduce the deviation. The desired idle speed setting means may be connected with a sensor, such as a coolant temperature sensor, for sensing a vehicle or engine operating condition such as the temperature of the coolant of the engine, and may be designed to determine the desired idle speed in accordance with the sensed condition such as the coolant temperature. The comparing means corresponds to the step S3 of FIG. 3, and is connected with the means for sensing the actual engine speed, and the desired idle speed setting means. The third processing means may comprises a correcting means which comprises a steady correction determining means and a transient correction determining means. The steps S9 and S10 correspond to the transient correction determining means. The correcting means is connected with the means for sensing the load of the auxiliary system. The steps S6–S11 correspond to the correcting means. The second processing means may comprise a control signal producing means for producing the control signal representing the sum of the feedback control quantity, and the steady and transient correction quantities. The step S12 corresponds to the control signal producing means. The control signal producing means is connected with each of the feedback controlling means, the steady correction determining means, and the transient correction determining means to receive a signal from each of these means. The control signal producing means is connected with the idle control valve, and arranged to deliver the control signal to the idle control valve. The idle detecting means may be connected with the control signal producing means, or may be connected with each of the first, second and third processing means.

What is claimed is:

1. An idle speed control system for an internal combustion engine, said control system comprising:

an idle control valve disposed in a bypass passage bypassing a throttle valve provided in an intake passage for the engine;

a sensing means for sensing an idling condition, an engine speed of the engine, and a load of an auxiliary device; and a controlling means for determining a desired idle speed, controlling an opening degree of said idle control valve during idling so as to maintain said desired idle speed, and further controlling the opening degree of said idle control valve in response to the load of the auxiliary device in such a transient manner that the opening degree of said idle control valve is increased when the load is applied, and then decreased with time.

2. An idle speed control system according to claim 1 wherein said sensing means comprises a first sensor means for sensing said idling condition of said engine, a second sensor means for sensing said engine speed, and a third sensor means for sensing said load, and said controlling means comprises a first processing means for setting said desired idle speed, a second processing means for controlling the opening degree of said idle control valve so as to reduce a deviation of an actual idle speed of said engine sensed by said second sensor means, from said desired idle speed, and a third processing means for initially increasing the opening degree of said idle control valve when the load of said auxiliary device is applied, and decreasing the opening degree with time.

3. An idle speed control system according to claim 2 wherein said third sensor means includes a means for producing a load condition signal which is in an on indicating signal state indicating that said auxiliary device is in an on state, and which is in an off indicating signal state indicating that said device in an off state, and said first processing means comprises a desired speed setting means for determining said desired idle speed, a comparing means for comparing said actual idle speed with said desired idle speed to determine said deviation, and a feedback means for determining a feedback control quantity so as to reduce said deviation, said third processing means comprises a correcting means for determining a steady correction quantity and a transient correction quantity in accordance with said load, and said second processing means comprises a control signal producing means for producing a control signal representing a sum of said feedback control quantity, said steady correction quantity and said transient correction quantity, said steady and transient correction quantities being both held equal to zero when said load condition signal is in the off indicating signal state, said transient correction quantity being set equal to a predetermined initial value when said load condition signal is changed from said off indicating signal state to said on indicating signal state, and then decreased gradually from said initial value with an increase of a time duration during which said load condition signal remains in the on indicating signal state.

4. An idle speed control system according to claim 3 wherein said first sensor means comprises an idle switch for sensing a position of the throttle valve and producing an idle signal when the throttle valve is in a closed position, said second sensor means comprises a crank angle sensor for sensing a rotational angular movement of a rotating member of the engine, and said third sensor means comprises a switch for turning on and off said auxiliary device.

5. An idle speed control system according to claim 4 wherein said idle speed control system and the engine are mounted on a vehicle, and said switch of said third sensor means is an air conditioner switch for turning on and off said auxiliary device which is a compressor of an air conditioner of the vehicle.

* * * * *